US005525946A

United States Patent [19]

Tsujiguchi et al.

[11] Patent Number: 5,525,946

[45] Date of Patent: Jun. 11, 1996

[54] DIELECTRIC RESONATOR APPARATUS COMPRISING A PLURALITY OF ONE-HALF WAVELENGTH DIELECTRIC COAXIAL RESONATORS HAVING OPEN-CIRCUIT GAPS AT ENDS THEREOF

[75] Inventors: Tatsuya Tsujiguchi; Tadahiro Yorita, both of Kanazawa; Hitoshi Tada, Ishikawa-ken; Hideyuki Kato, Kanazawa; Yukihiro Kitaichi, Ishikawa-ken; Haruo Matsumoto, Kanazawa, all of Japan

[73] Assignee: Murata Manufacturing Co., Ltd., Japan

[21] Appl. No.: 306,207

[22] Filed: Sep. 14, 1994

[30] Foreign Application Priority Data

Sep. 16, 1993 [JP] Japan ..... 5-230282

[51] Int. Cl.[6] ..... H01P 1/202

[52] U.S. Cl. ..... 333/202; 333/206; 333/222

[58] Field of Search ..... 333/202, 203, 333/206, 207, 222

[56] References Cited

U.S. PATENT DOCUMENTS

| | | | |
|---|---|---|---|
| 4,523,162 | 6/1985 | Johnson | 333/202 |
| 5,130,683 | 7/1992 | Agahi-Kesheh et al. | 333/203 |
| 5,162,760 | 11/1992 | Phillips et al. | 333/206 |

FOREIGN PATENT DOCUMENTS

| | | | |
|---|---|---|---|
| 538896 | 4/1993 | European Pat. Off. | 333/202 DB |
| 49049 | 4/1979 | Japan | 333/222 |
| 5183309 | 7/1993 | Japan . | |
| 5199011 | 8/1993 | Japan . | |

*Primary Examiner*—Benny Lee

*Attorney, Agent, or Firm*—Ostrolenk, Faber, Gerb & Soffen

[57] ABSTRACT

A dielectric resonator apparatus comprising a plurality of dielectric coaxial resonators has a dielectric block with first and second surfaces and a plurality of side surfaces located therebetween, and a plurality of cylindrical resonator holes are formed in parallel to each other so as to penetrate the dielectric block, each of the resonator holes having an opening at the first surface and another opening at the second surface. Further, an outer conductor is formed on the first and second surfaces and a plurality of side surfaces, and a plurality of inner conductors is formed on the plurality of resonator holes, respectively. Then a plurality of extending conductors is formed in the vicinity of the openings of the plurality of resonator holes, respectively, so as to extend from the outer conductor to the plurality of resonator holes and to form gaps between the plurality of extending conductors and the inner conductors, each of the inner conductors having open-circuit ends in the vicinity of both the openings of the resonator holes, thereby constituting a plurality of dielectric coaxial resonators. Furthermore, a pair of input and output electrodes is formed on the side surfaces so as to be electrically insulated from the outer conductor.

10 Claims, 10 Drawing Sheets

DIELECTRIC RESONATOR APPARATUS COMPRISING A PLURALITY OF ONE-HALF WAVELENGTH DIELECTRIC COAXIAL RESONATORS HAVING OPEN-CIRCUIT GAPS AT ENDS THEREOF

BACKGROUND OF THE INVENTION

1. Field of the Invention

The present invention relates to a dielectric resonator apparatus, and more particularly, to a dielectric resonator apparatus comprising a plurality of dielectric coaxial resonators, which is generally used as a dielectric filter.

2. Description of the Prior Art

Conventionally, there has been widely used as a dielectric band-pass filter for microwave band frequencies, for example, a dielectric resonator apparatus comprising a plurality of dielectric coaxial resonators, each of which is formed by forming a resonator hole in an inner portion of a dielectric block, forming an inner electric conductor in the resonator hole and forming an outer electric conductor on an outer surface of the dielectric block. In the specification, an electric conductor is referred to as a conductor hereinafter.

FIG. 9 is a perspective view showing an appearance of a first conventional dielectric resonator apparatus. In the first conventional dielectric resonator apparatus, a pair of input and output electrodes is formed on the outer surface of the dielectric block in the above-mentioned dielectric resonator apparatus, and the longitudinal length of the resonator holes or of the axis of each resonator is set to half the guide-wavelength $\lambda g/2$, resulting in a plurality of half-wavelength dielectric coaxial resonators.

Referring to FIG. 9, two circular cylindrical resonator holes 2*a* and 2*b* are formed in parallel to each other so as to penetrate a rectangular-parallelepiped-shaped dielectric block 1 between first and second surfaces S1 and S2 of the dielectric block 1, and an inner conductor is formed on an inner peripheral surface of each of the resonator holes 2*a* and 2*b*. Further, an outer conductor 6 is formed on the first and second surfaces S1 and S2 and the side surfaces S3, S4, S5 and S6 of the dielectric block 1. Furthermore, a pair of input and output electrodes 7*a* and 7*b* is formed on the side surface S3 of the dielectric block 1 so as to be electrically insulated from the outer conductor 6. Thus, there can be constituted the first conventional dielectric resonator apparatus comprising the two half-wavelength dielectric coaxial resonators.

FIG. 10 is a perspective view showing an appearance of a second conventional dielectric resonator apparatus having first, second and third cylindrical resonator holes 2*a*, 2*b* and 2*c*, an outer conductor 6, and input and output electrodes similar to those in FIG. 9. As shown in FIG. 10, in the case of the dielectric resonator apparatus of three or more stages, it is necessary to change the lengths of the axes of the dielectric coaxial resonators, and therefore, it is necessary to form steps in the dielectric block 1.

Since both of the opening surfaces S1 and S2 of the resonator holes 2*a* and 2*b* in FIG. 9 are short-circuit surfaces, no leakage of the electromagnetic field occurs there. However, a current concentration is caused at a short-circuit end of the inner conductor, namely, at a boundary between the inner conductor and the outer conductor 6, resulting in a deterioration in the unloaded Q ($Q_0$) of each of the dielectric coaxial resonators.

Further, as shown in FIG. 10, in the dielectric resonator apparatus of three or more stages, it is necessary to process the dielectric block 1, resulting in an increase in the manufacturing cost.

SUMMARY OF THE INVENTION

The object of the present invention is therefore to provide a dielectric resonator apparatus comprising a plurality of dielectric coaxial resonators, without any deterioration in the unloaded Q ($Q_0$) due to both of the opening surfaces S1 and S2 of the resonator holes 2*a* and 2*b* being short-circuit surfaces.

Another object of the present invention is to provide a dielectric resonator apparatus comprising a plurality of dielectric coaxial resonators, having a simpler structure and a lower manufacturing cost than the conventional dielectric resonator apparatuses.

In order to achieve the aforementioned objectives, according to one aspect of the present invention, there is provided a dielectric resonator apparatus comprising:

a dielectric block of a dielectric material having first and second surfaces, and a plurality of side surfaces located between the first surface and the second surface;

a plurality of cylindrical resonator holes formed in parallel to each other so as to penetrate an inner portion of the dielectric block, each of the resonator holes having an opening on the first surface of the dielectric block and another opening on the second surface of the dielectric block;

an outer conductor formed on the first and second surfaces and the plurality of side surfaces of the dielectric block;

a plurality of inner conductors formed on inner portions of the plurality of resonator holes, respectively;

a plurality of extending conductors formed in the vicinity of the openings of the plurality of resonator holes, respectively, so as to extend from the outer conductor to the inner portions of the plurality of resonator holes and so as to form gaps between the plurality of extending conductors and the inner conductors, each of the inner conductors having open-circuit ends in the vicinity of both the openings of the resonator holes, thereby constituting a plurality of dielectric coaxial resonators; and a pair of input and output electrodes formed on the side surfaces of the dielectric block so as to be electrically insulated from the outer conductor, and so as to be close to the two inner conductors located at both ends of the plurality of inner conductors, respectively.

In the above-mentioned dielectric resonator apparatus, the pair of input and output electrodes are preferably formed so as to be close to the first surface of the dielectric block.

In the above-mentioned dielectric resonator apparatus, the pair of input and output electrodes are preferably formed diagonally on one side surface, respectively, so as to be close to the first and second surface of the dielectric block.

In the above-mentioned dielectric resonator apparatus, the plurality of inner conductors are preferably formed so as to be symmetrical with respect to the center axis of the inner conductor located in the center of the plurality of inner conductors.

In the above-mentioned dielectric resonator apparatus, the apparatus preferably comprises three dielectric coaxial resonators, each of the longitudinal lengths of the inner conductors located at both ends of the dielectric block being set to a first length, and the longitudinal length of the inner conductor located in the center of the dielectric block being set to a second length longer than the first length.

The above-mentioned dielectric resonator apparatus preferably further comprises:

a pair of penetrating holes formed in a direction perpendicular to the axial direction of the resonator holes so as to penetrate the dielectric block and so as to extend from a pair of input and output electrodes to the resonator holes located both ends of the dielectric block; and inner connection conductors for electrically connecting the pair of input and output electrode to the inner conductors located at both ends of the dielectric block, respectively, the inner connection conductors being formed in inner portions of the pair of penetrating holes, respectively.

BRIEF DESCRIPTION OF THE DRAWINGS

These and other objects and features of the present invention will become clear from the following description of preferred embodiments thereof with reference to the accompanying drawings throughout which like parts are designated by like reference numerals, and in which.

DETAILED DESCRIPTION OF THE PREFERRED EMBODIMENTS

The preferred embodiments according to the present invention will be described below with reference to the attached drawings.

First Preferred Embodiment

Figure 1:
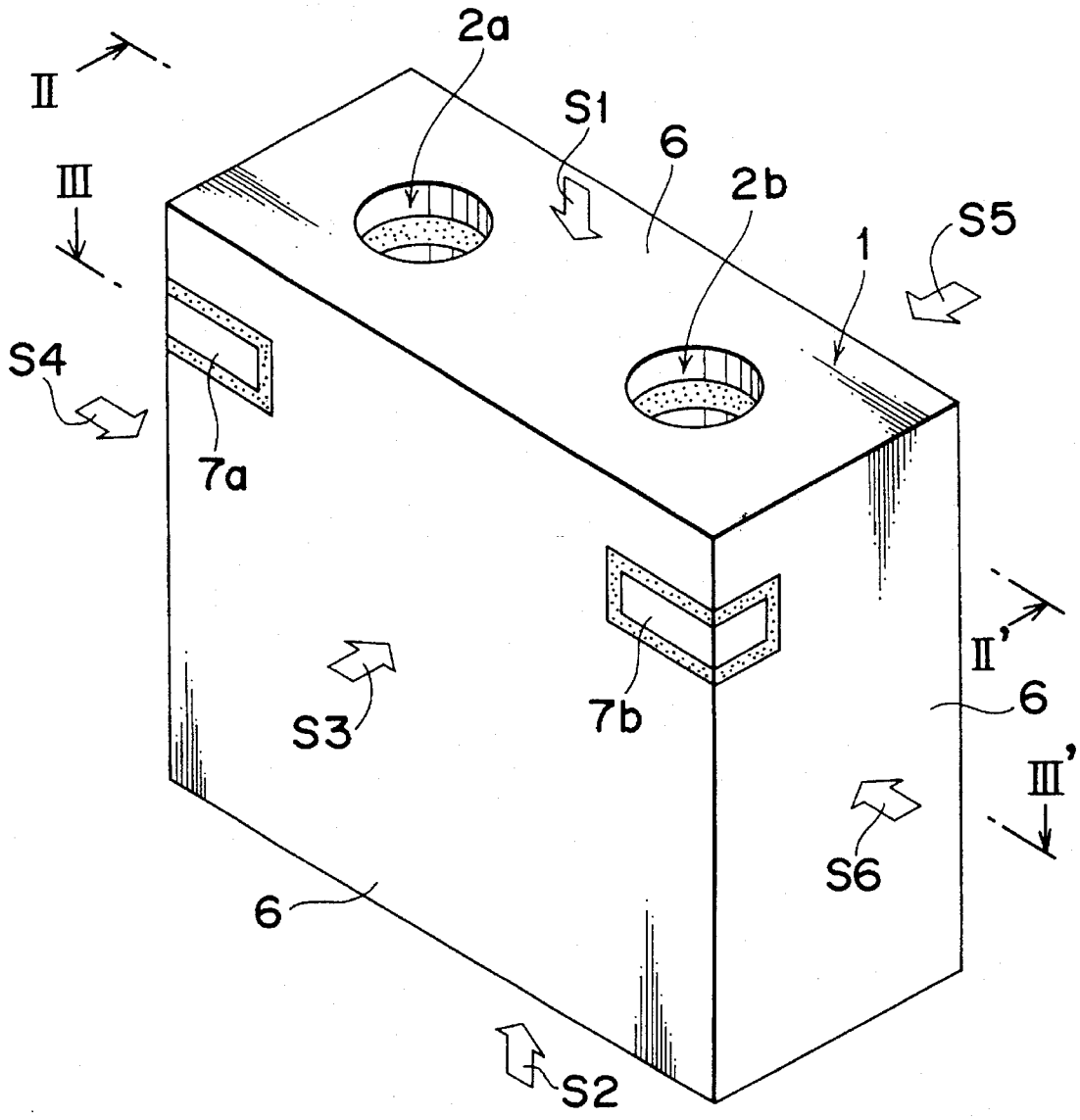
FIG. 1 is a perspective view showing an appearance of a dielectric resonator apparatus according to a first preferred embodiment of the present invention.

FIG. 1 is a perspective view showing an appearance of a dielectric resonator apparatus according to a first preferred embodiment of the present invention.

Referring to FIG. 1, a dielectric block 1 of a dielectric material such as ceramics or the like of the dielectric resonator apparatus is in a shape of a rectangular parallelepiped including six surfaces, wherein the six surfaces include first and second surfaces S1 and S2 which are opposed to each other, and four side surfaces S3, S4, S5 and S6 located between the first and second surfaces S1 and S2. Two circular cylindrical resonator holes **2*a* and 2*b* are formed in parallel to each other in the dielectric block 1 so as to penetrate the dielectric block 1 between the first and second surfaces S1 and S2, and then inner conductors 3*a* and 3*b* are formed in the resonator holes 2*a* and 2*b* as described later with reference to FIG. 2, respectively. Further, an outer conductor 6 which becomes an earth electrode is formed on the first and second surfaces S1 and S2, and the four side surfaces S3, S4, S5 and S6 of the dielectric block 1. Furthermore, a pair of input and output electrodes 7*a* and 7*b* for inputting and outputting a high-frequency signal is formed respectively in two areas so as to be electrically insulated from the outer conductor 6 and so as to be close to one end of each of the inner conductors 3*a* and 3*b*, respectively, wherein one area is located from the side surface S3 of the dielectric block 1 to the side surface S4 thereof, and another area is located from the side surface S3 of the dielectric block 1 to the side surface S6** thereof.

Figure 2:
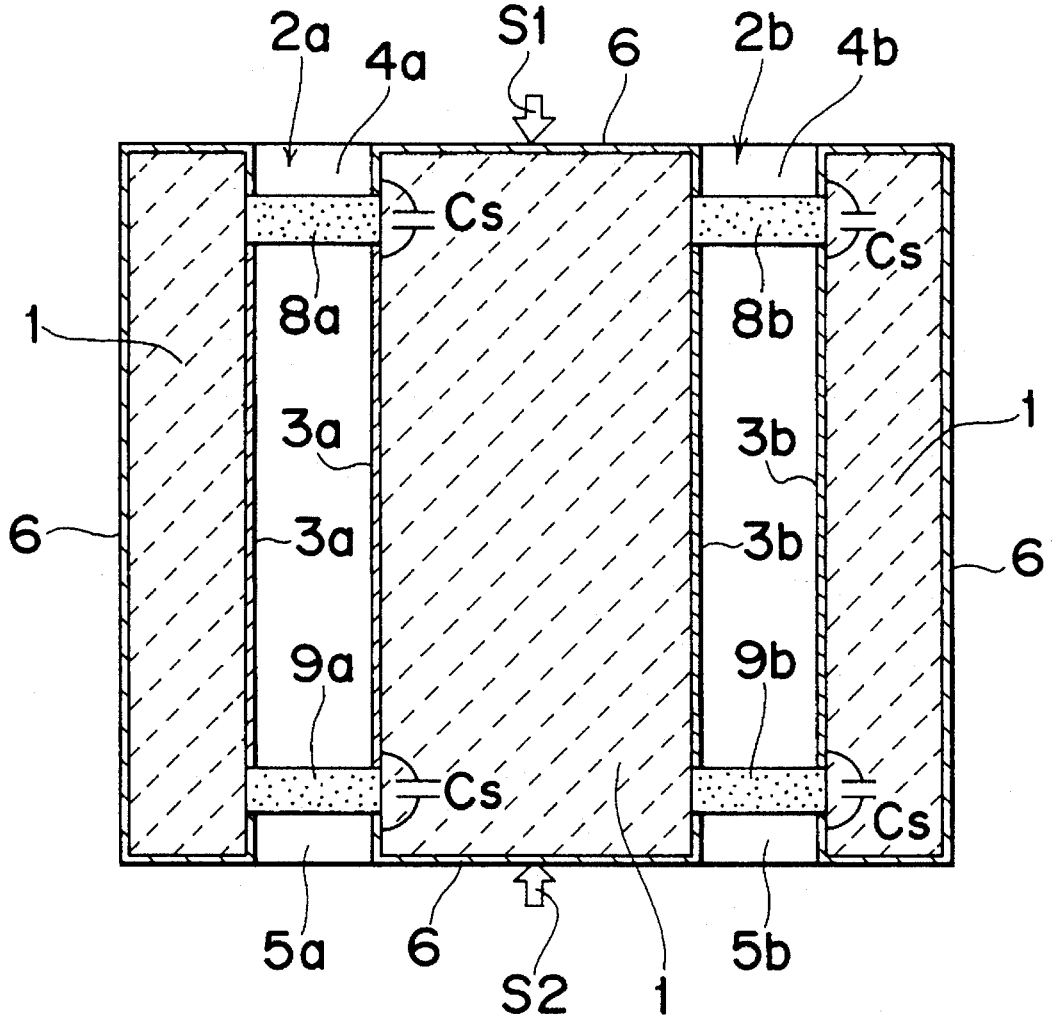
FIG. 2 is a cross-sectional view along a line II–II' of FIG. 1.

FIG. 2 is a cross-sectional view along a line II–II' of FIG. 1.

Referring to FIG. 2, the inner conductors **3*a* and 3*b* are formed respectively on the inner peripheral surfaces of the resonator holes 2*a* and 2*b*. Extending conductors 4*a* and 4*b* are formed respectively on the inner peripheral surfaces of the resonator holes 2*a* and 2*b* so as to slightly extend from the outer conductor 6 formed on the first surface S1 of the dielectric block 1 into the inner portion of the resonator holes 2*a* and 2*b*, namely, so as to be electrically connected to the outer conductor 6 formed on the first surface S1 of the dielectric block 1. On the other hand, further extending conductors 5*a* and 5*b* are formed respectively on the inner peripheral surfaces of the resonator holes 2*a* and 2*b* so as to slightly extend from the outer conductor 6 formed the second surface S2 of the dielectric block 1 into the inner portion of the resonator holes 2*a* and 2*b*, namely, so as to be electrically connected to the outer conductor 6 formed on the second surface S2 of the dielectric block 1**.

In this arrangement of the dielectric resonator apparatus, a gap **8*a* is formed in the resonator hole 2*a* between the end of the inner conductor 3*a* and the end of extending conductor 4*a*, and a gap 9*a* is formed in the resonator hole 2*a* between another end of the inner conductor 3*a* and the end of extending conductor 5*a*. Further, a gap 8*b* is formed in the resonator hole 2*b* between the end of the inner conductor 3*b* and the end of extending conductor 4*b*, and a gap 9*b* is formed in the resonator hole 2*b* between another end of the inner conductor 3*b* and the end of extending conductor 5*b*. In this arrangement, the inner conductor 3*a* is electrically insulated from the extending conductor 4*a* by the gap 8*a*, and is electrically insulated from the extending conductor 5*a* by the gap 9*a*. Further, the inner conductor 3*b* is electrically insulated from the extending conductor 4*b* by the gap 8*b*, and is electrically insulated from the extending conductor 5*b* by the gap 9*b***.

It is robe noted that the longitudinal length of each of the inner conductors **3*a* and 3*b*** is set to half the guide-wavelength $\lambda g/2$.

As a result, end capacitances Cs are formed respectively in the gaps **8*a*, 9*a*, 8*b* and 9*b*, namely, between the end of the inner conductor 3*a* and the end of extending conductor 4*a*, between another end of the inner conductor 3a and the end of extending conductor 5a, between the end of the inner conductor 3b and the end of extending conductor 4b, and between another end of the inner conductor 3b and the end of extending conductor 5b. Thus, open-circuit ends of the inner conductors 3a and 3b are formed respectively in the vicinity of both openings of the resonator holes 2a and 2b which are respectively formed at the first and second surfaces S1 and S2 of the dielectric block 1**.

In the above-mentioned arrangement, two half-wavelength dielectric coaxial resonators R1 and R2 (FIG. 4) corresponding to the inner conductors 3a and 3b are formed in the dielectric block 1 as shown in FIG. 2.

Figure 3:
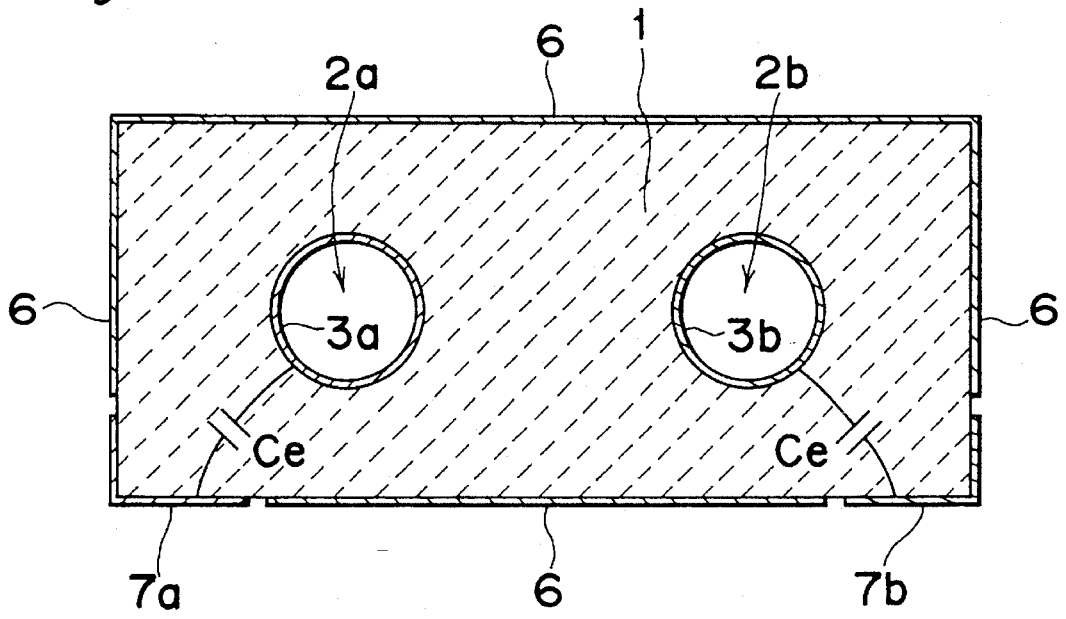
FIG. 3 is a cross-sectional view along a line III–III' of FIG. 1.

FIG. 3 is a cross-sectional view along a line III–III' of FIG. 1.

As shown in FIG. 3, external coupling capacitances Ce are formed respectively between the input electrode 7a and the vicinity of one end of the inner conductor 3a and between the output electrode 7b and the vicinity of one end of the inner conductor 3b.

Figure 4:
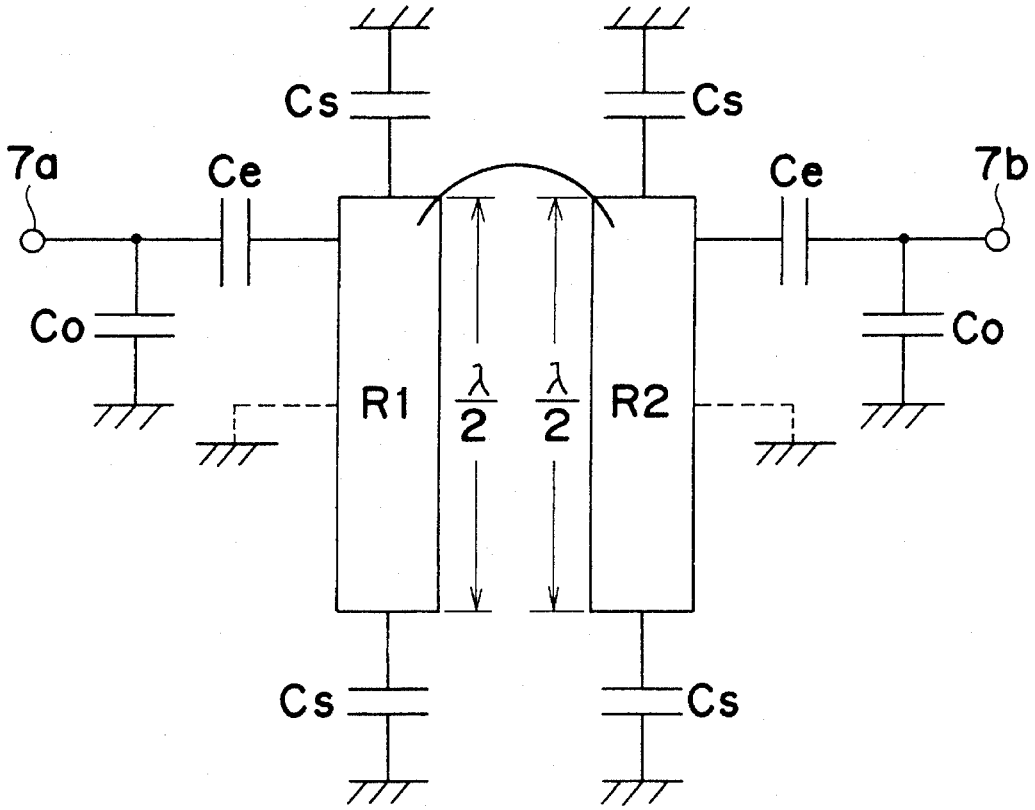
FIG. 4 is an circuit diagram of an equivalent circuit of the dielectric resonator apparatus of the first preferred embodiment shown in FIGS. 1 to 3.

FIG. 4 is a circuit diagram of an equivalent circuit of the dielectric resonator apparatus of the first preferred embodiment shown in FIGS. 1 to 3, which is obtained from the above-mentioned description.

Referring to FIG. 4, R1 and R2 denote first and second half-wavelength dielectric coaxial resonators including the inner conductors 3a and 3b shown in FIG. 2, respectively. Capacitances $C_0$ are floating capacitances respectively formed between the input electrode 7a and the outer conductor 6 of the earth electrode, and between the output electrode 7b and the outer conductor 6 of the earth electrode.

As is apparent from the equivalent circuit of FIG. 4, the short-circuit surfaces of the respective half-wavelength ($\lambda/2$) dielectric coaxial resonators R1 and R2 are located respectively in the center of the inner conductors 3a and 3b. Therefore, the no-loaded Q ($Q_0$) of the dielectric resonator apparatus of the present preferred embodiment becomes larger than that of the conventional dielectric resonator apparatus comprising a plurality of half-wavelength dielectric coaxial resonators, both ends of each of which become the short-circuit surfaces.

In other words, the dielectric resonator apparatus of the present preferred embodiment comprises the two half-wavelength dielectric coaxial resonators R1 and R2 connected in series between a pair of input and output electrodes 7a and 7b, wherein each of the two half-wavelength dielectric coaxial resonators R1 and R2 has additional end capacitances Cs formed at both the open-circuit ends thereof.

Second Preferred Embodiment

Figure 5:
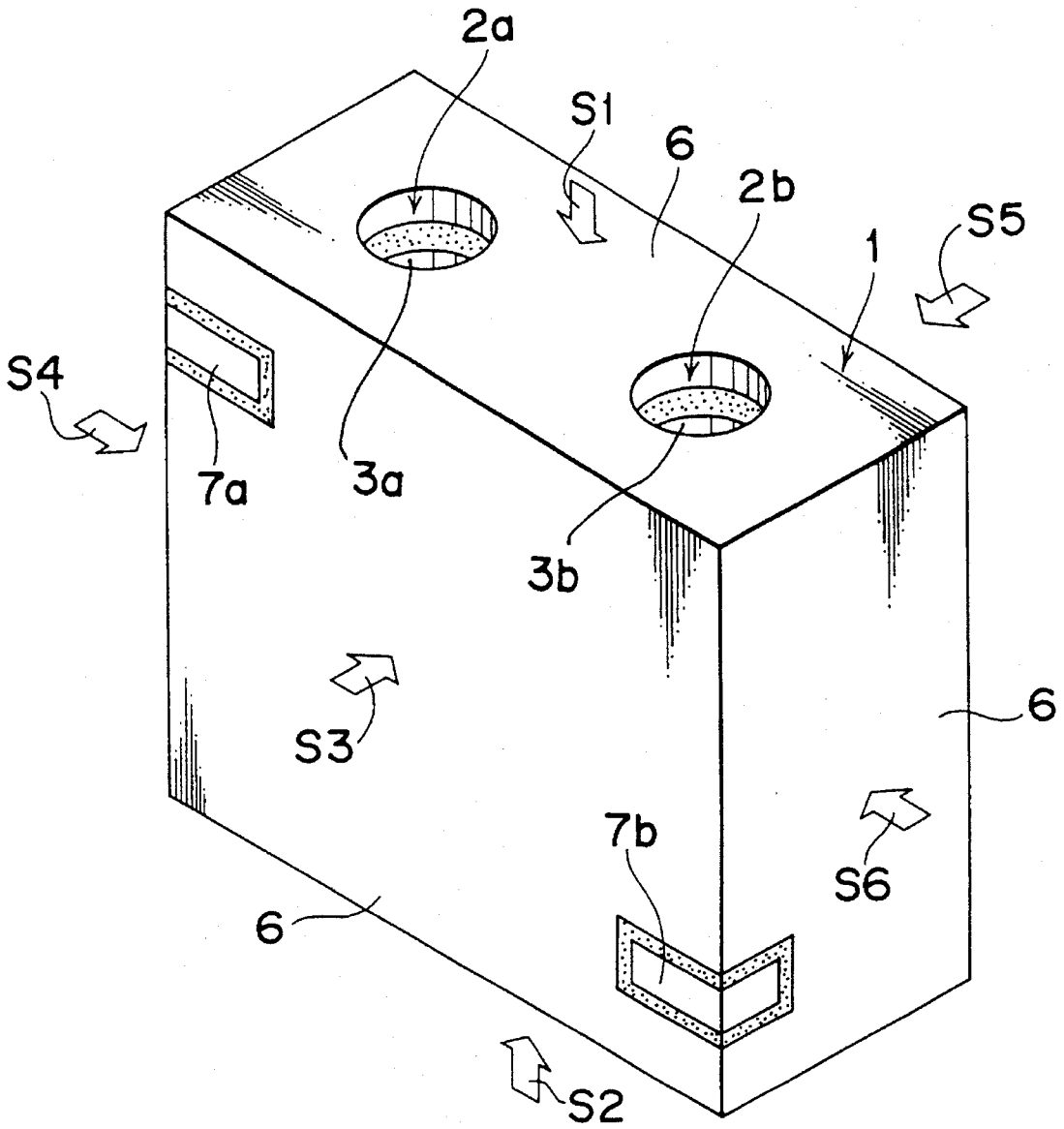
FIG. 5 is a perspective view showing an appearance of a dielectric resonator apparatus according to a second preferred embodiment of the present invention.

FIG. 5 is a perspective view showing an appearance of a dielectric resonator apparatus according to a second preferred embodiment of the present invention.

As is apparent from a comparison between FIGS. 1 and 5, the difference between the dielectric resonator apparatuses of the first and second preferred embodiments is the positions of a pair of input and output electrodes 7a and 7b. Referring to FIG. 5, the input electrode 7a is formed to be electrically insulated from the outer conductor 6, in an area located from the side surface S3 of the dielectric block 1 to the side surface S4 thereof so as to be close to the first surface S1 of the dielectric block 1 and be close to one end of the inner conductor 3a. On the other hand, the output electrode 7b is formed to be electrically insulated from the outer conductor 6, in another area located from the side surface S3 of the dielectric block 1 to the side surface S6 thereof so as to be close to the second surface S2 of the dielectric block 1 and be close to another end of the inner conductor 3b. In other words, a pair of input and output electrodes 7a and 7b is formed diagonally on the side surface S3 of the dielectric block 1.

Figure 6:
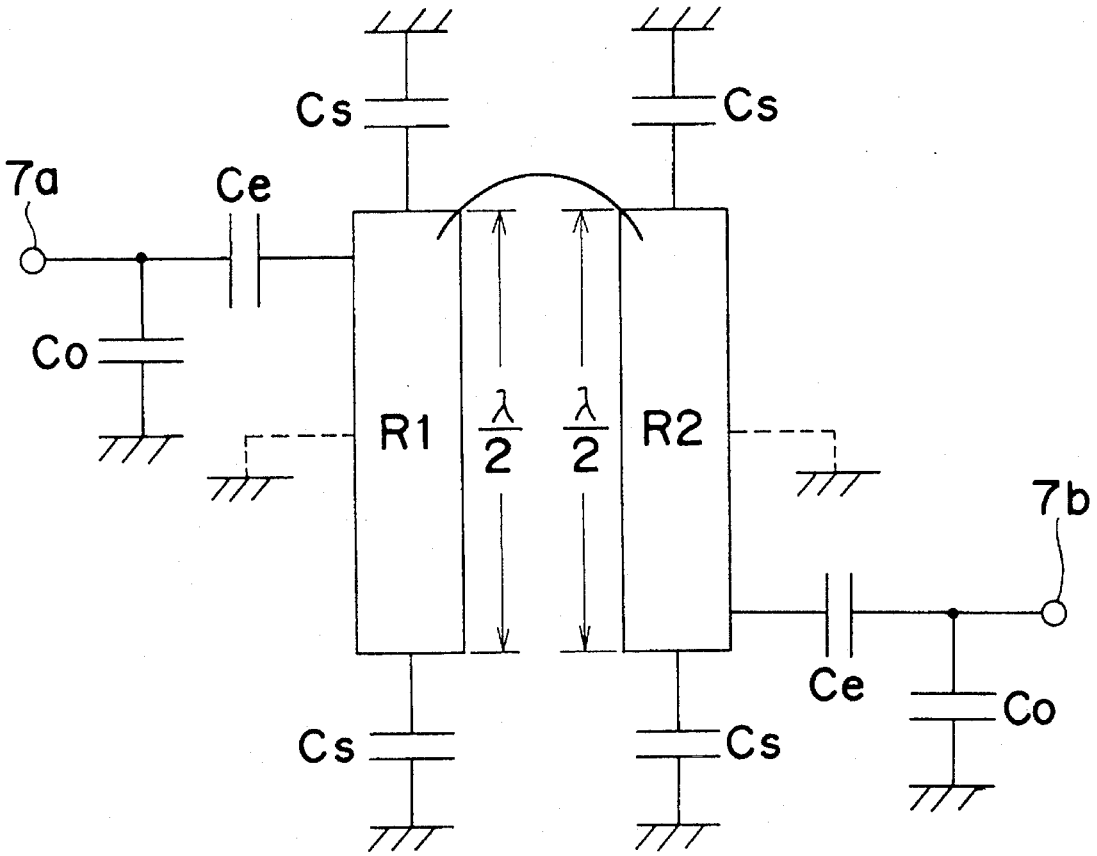
FIG. 6 is an circuit diagram of an equivalent circuit of the dielectric resonator apparatus of the second preferred embodiment shown in FIG. 5.

FIG. 6 is an circuit diagram of an equivalent circuit of the dielectric resonator apparatus of the second preferred embodiment shown in FIG. 5.

As shown in FIG. 6, an external coupling capacitance Ce is formed between the input electrode 7a and the vicinity of one open-circuit end of the inner conductor 3a of the first dielectric coaxial resonator R1, and another external coupling capacitance Ce is formed between the output electrode 7b and the vicinity of another open-circuit end of the inner conductor 3b of the second dielectric coaxial resonator R2, which is located so as to be opposite to one open-circuit end of the inner conductor 3a of the first dielectric coaxial resonator R1, which becomes one end of the external coupling capacitance Ce. This results in that the dielectric resonator apparatus of the present preferred embodiment comprises the two half-wavelength dielectric coaxial resonators R1 and R2 connected in series between a pair of input and output electrode 7a and 7b, wherein each of the two half-wavelength dielectric coaxial resonators R1 and R2 has additional end capacitances Cs formed at both the open-circuit ends thereof located so as to be opposite to each other.

Third Preferred Embodiment

Figure 7:
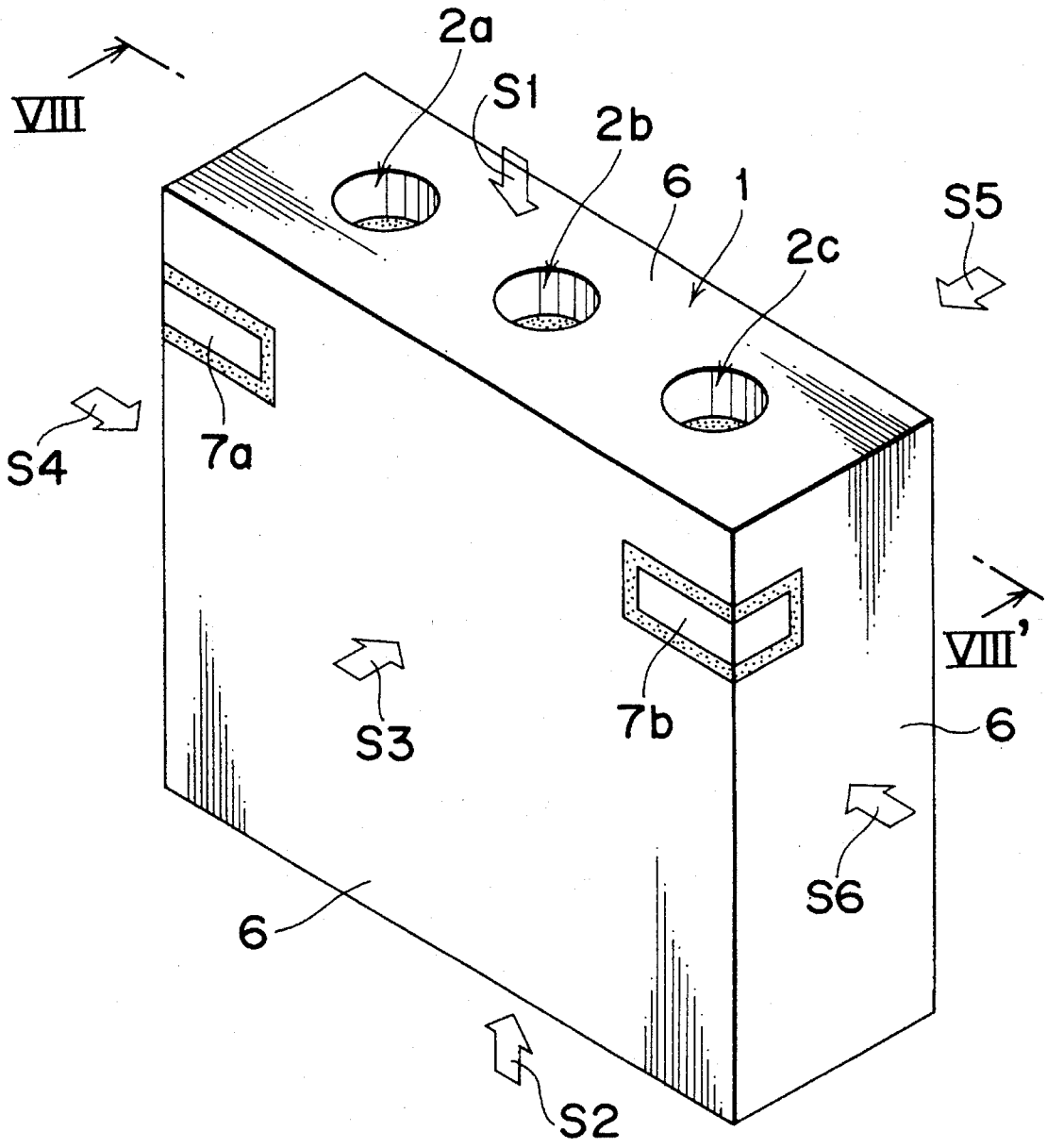
FIG. 7 is a perspective view showing an appearance of a dielectric resonator apparatus according to a third preferred embodiment of the present invention.

FIG. 7 is a perspective view showing an appearance of a dielectric resonator apparatus according to a third preferred embodiment of the present invention.

Referring to FIG. 7, a dielectric block 1 of the dielectric resonator apparatus of the third preferred embodiment is in a shape of a rectangular parallelepiped including six surfaces, in a manner similar to the first and second preferred embodiments. Three circular cylindrical resonator holes 2a, 2b and 2c are formed in parallel to each other in the dielectric block 1 so as to penetrate the dielectric block 1 between the first and second surfaces S1 and S2, and then inner conductors 3a, 3b and 3c are formed in the resonator holes 2a, 2b and 2c as described later with reference to FIG. 8, respectively. Further, an outer conductor 6 which becomes an earth electrode is formed on the first and second surfaces S1 and S2, and the four side surfaces S3, S4, S5, and S6 of the dielectric block 1.

Furthermore, a pair of input and output electrodes 7a and 7b for inputting and outputting a high-frequency signal is formed respectively in two areas so as to be electrically insulated from the outer conductor 6 and so as to be close to the inner conductors 3a and 3c, respectively (see FIG. 8), wherein one area is located from the side surface S3 of the dielectric block 1 to the side surface S4 thereof, and another area is located from the side surface S3 of the dielectric block 1 to the side surface S6 thereof. In this case, an external coupling capacitance is formed between the input electrode 7a and the vicinity of one open-circuit end of the inner conductor 3a formed in the resonator hole 2a which is located close to the first surface S1 of the dielectric block 1, whereas another external coupling capacitance is formed between the output electrode 7b and the vicinity of one open-circuit end of the inner conductor 3c formed in the resonator hole 2c which is located close to the first surface S1 of the dielectric block 1.

Figure 8:
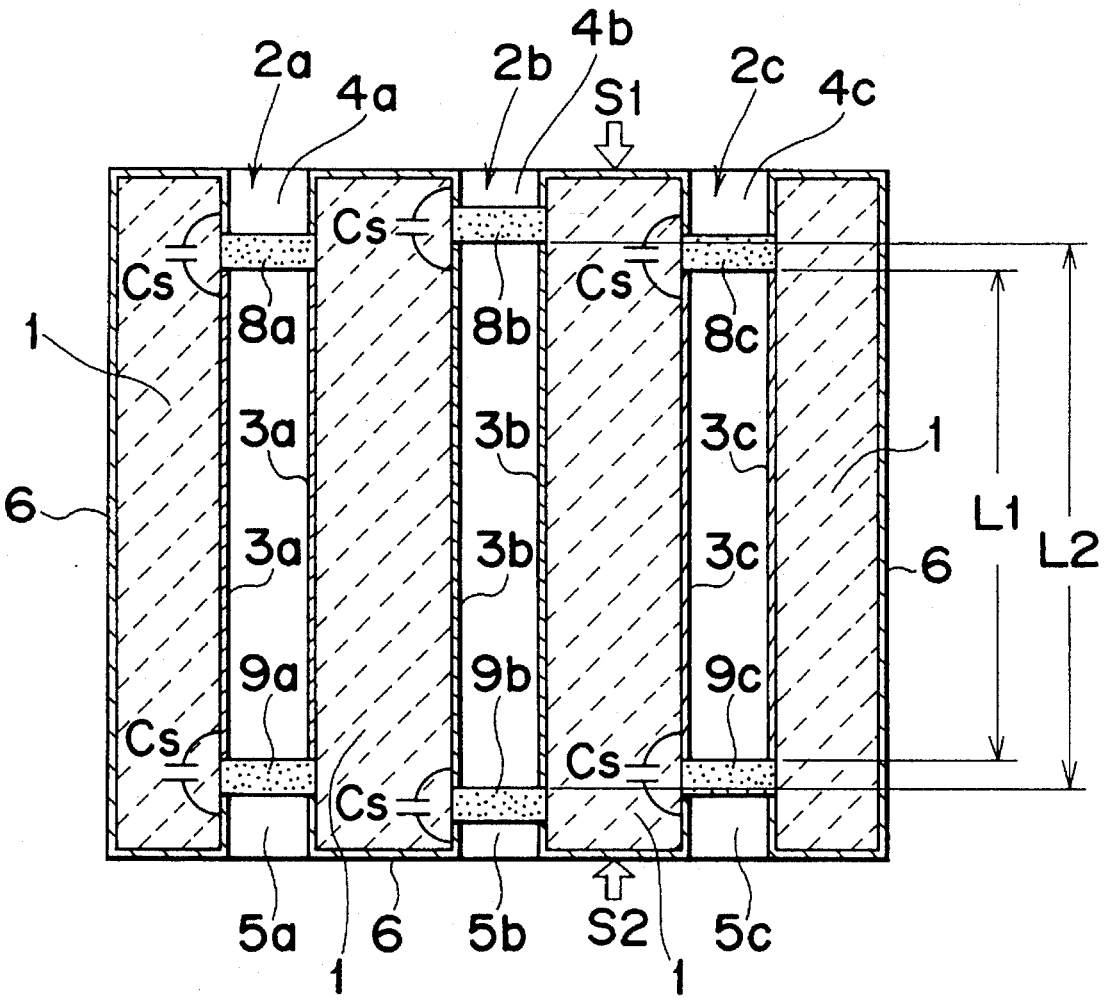
FIG. 8 is a cross-sectional view along a line VIII–VIII' of FIG. 7.
Figure 9:
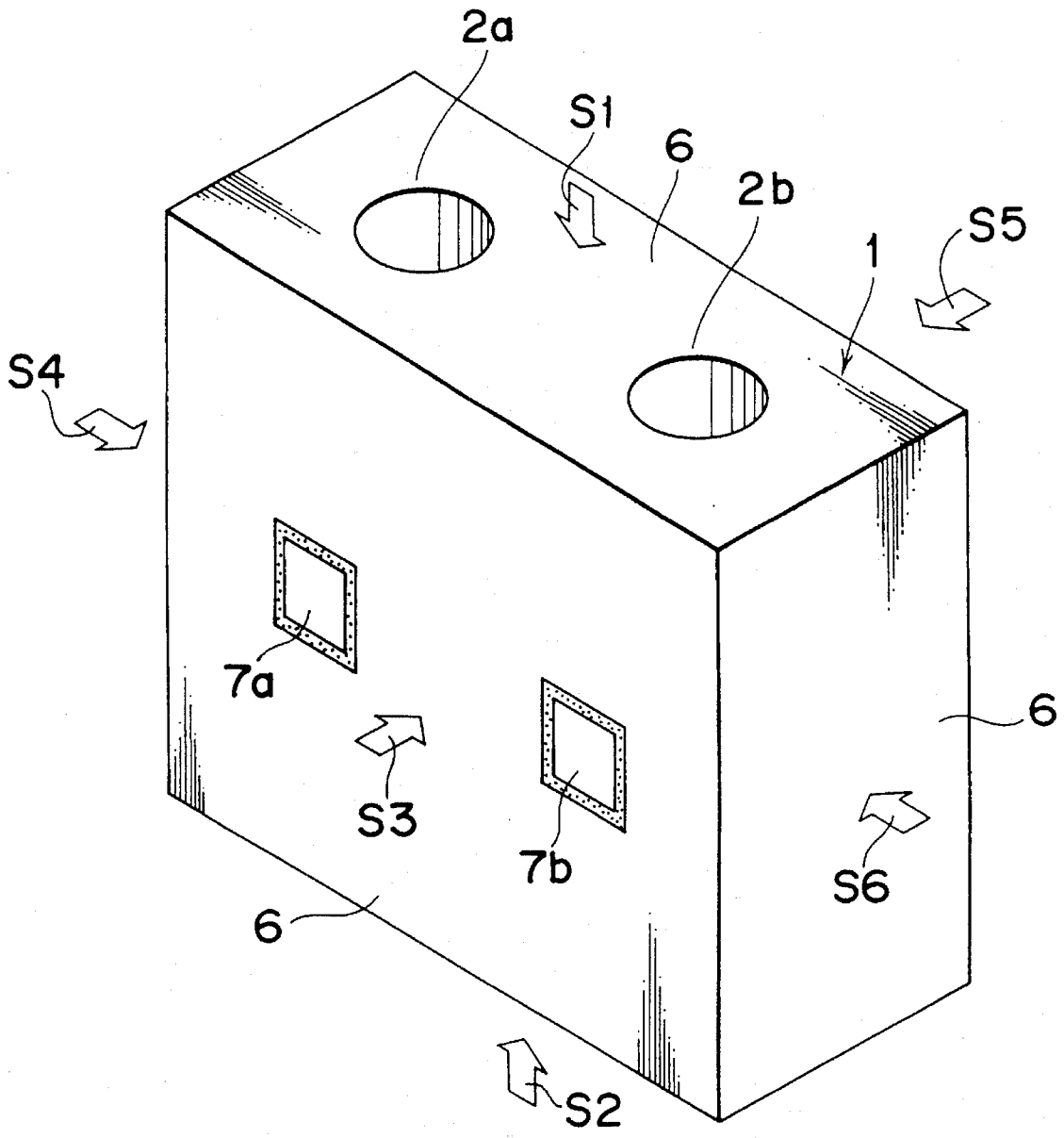
Fig. 9 PRIOR ART
FIG. 9 is a perspective view showing an appearance of a first conventional dielectric resonator apparatus comprising two half-wavelength dielectric resonators.

FIG. 8 is a cross-sectional view along a line VIII–VIII' of FIG. 7.

Referring to FIG. 8, the inner conductors 3a, 3b and 3c are formed respectively on the inner peripheral surfaces of the resonator holes 2a, 2b and 2c so as to be symmetrical with respect to the center axes of the resonator hole 2b. Extending conductors 4a, 4b and 4c are formed respectively on the inner peripheral surfaces of the resonator holes 2*a*, 2*b* and 2*c* so as to slightly extend from the first surface S1 of the dielectric block 1 into the inner portion of the resonator holes 2*a*, 2*b* and 2*c*, namely, so as to be electrically connected to the outer conductor 6 formed on the first surface S1 of the dielectric block 1. On the other hand, further extending conductors 5*a*, 5*b* and 5*c* are formed respectively on the inner peripheral surfaces of the resonator holes 2*a*, 2*b* and 2*c* so as to slightly extend from the second surface S2 of the dielectric block 1 into the inner portion of the resonator holes 2*a*, 2*b* and 2*c*, namely, so as to be electrically connected to the outer conductor 6 formed on the second surface S2 of the dielectric block 1.

In this arrangement of the dielectric resonator apparatus, a gap 8*a* is formed in the resonator hole 2*a* between the end of the inner conductor 3*a* and the end of extending conductor 4*a*, and a gap 9*a* is formed in the resonator hole 2*a* between another end of the inner conductor 3*a* and the end of extending conductor 5*a*. Further, a gap 8*b* is formed in the resonator hole 2*b* between the end of the inner conductor 3*b* and the end of extending conductor 4*b*, and a gap 9*b* is formed in the resonator hole 2*b* between another end of the inner conductor 3*b* and the end of extending conductor 5*b*. Furthermore, a gap 8*c* is formed in the resonator hole 2*c* between the end of the inner conductor 3*c* and the end of extending conductor 4*c*, and a gap 9*c* is formed in the resonator hole 2*c* between another end of the inner conductor 3*c* and the end of extending conductor 5*c*.

As a result, end capacitances Cs are formed respectively in the gaps 8*a*, 9*a*, 8*b*, 9*b*, 8*c* and 9*c*, namely, between the end of the inner conductor 3*a* and the end of extending conductor 4*a*, between another end of the inner conductor 3*a* and the end of extending conductor 5*a*, between the end of the inner conductor 3*b* and the end of extending conductor 4*b*, between another end of the inner conductor 3*b* and the end of extending conductor 5*b*, between the end of the inner conductor 3*c* and the end of extending conductor 4*c*, and between another end of the inner conductor 3*c* and the end of extending conductor 5*c*. Thus, open-circuit ends of the inner conductors 3*a*, 3*b* and 3*c* are formed respectively in the vicinity of both openings of the resonator holes 2*a*, 2*b* and 2*c* which are respectively formed at the first and second surfaces S1 and S2 of the dielectric block 1.

Further, external coupling capacitances are formed respectively between the input electrode 7*a* and the vicinity of one end of the inner conductor 3*a* and between the output electrode 7*b* and the vicinity of one end of the inner conductor 3*c*.

In the above-mentioned arrangement, three dielectric coaxial resonators corresponding to the inner conductors 3*a*, 3*b* and 3*c* are formed in the dielectric block 1 so as to be electrically connected in series to each other between a pair of input and output electrodes 7*a* and 7*b*. Respective resonance frequencies $f_0$ of the three dielectric coaxial resonators can be determined based on the longitudinal lengths of the inner conductors 3*a*, 3*b* and 3*c* and the end capacitances Cs formed at the both open-circuit ends of the inner conductors 3*a*, 3*b* and 3*c*, and further, a degree of coupling between each pair of adjacent dielectric coaxial resonators can be determined based on the end capacitances Cs.

In the present preferred embodiment, as shown in FIG. 8, the longitudinal length of each of the inner conductors 3*a* and 3*c* is set to a length L1, and the longitudinal length of the inner conductor 3*b* is set to a length L2, wherein the length L1 is smaller than the length L2. In this case, respective resonance frequencies of the three dielectric coaxial resonators and the degree of coupling between the adjacent dielectric coaxial resonators are determined. As a result, there can be obtained the dielectric resonator apparatus of the third preferred embodiment having a predetermined band-pass characteristic, which is used as a band-pass dielectric filter.

In all the first to third preferred embodiments, the longitudinal lengths of the respective inner conductors 3*a*, 3*b* and 3*c* and the end capacitances Cs can be adjusted by adjusting the positions and widths of the gaps 8*a*, 9*a*, 8*b*, 9*b*, 8*c* and 9*c* formed in the resonator holes 2*a*, 2*b* and 2*c*. Further, the degree of coupling between the adjacent dielectric coaxial resonators and the resonance frequencies of the respective dielectric coaxial resonators can be adjusted by, for example, cutting a part of the outer conductor 6 and a part of the dielectric block 1.

Other Preferred Embodiments

In the above-mentioned dielectric resonator apparatuses of the preferred embodiments, there are formed two or three dielectric coaxial resonators. However, the present invention is not limited to this. There may be formed four or more dielectric coaxial resonators.

In the above-mentioned dielectric resonator apparatuses of the preferred embodiments, the circular cylindrical resonator holes 2*a*, 2*b* and 2*c* are formed in the dielectric block 1, but the present invention is not limited to this. Resonator holes having a shape such as a rectangular cylindrical shape, a hexagonal prism or the like may be formed.

In the above-mentioned first to third preferred embodiments, the external coupling capacitances Ce are formed, respectively, between the input electrode 7*a* and the inner conductor 3*a* formed in the resonator hole 2*a* located at the left end of the dielectric block 1, and between the output electrode 7*b* or 7*c* and the inner conductor 3*b* or 3*c* formed in the resonator hole 2*b* or 2*c* located at the right end of the dielectric block 1. However, the present invention is not limited to this.

Figure 11:
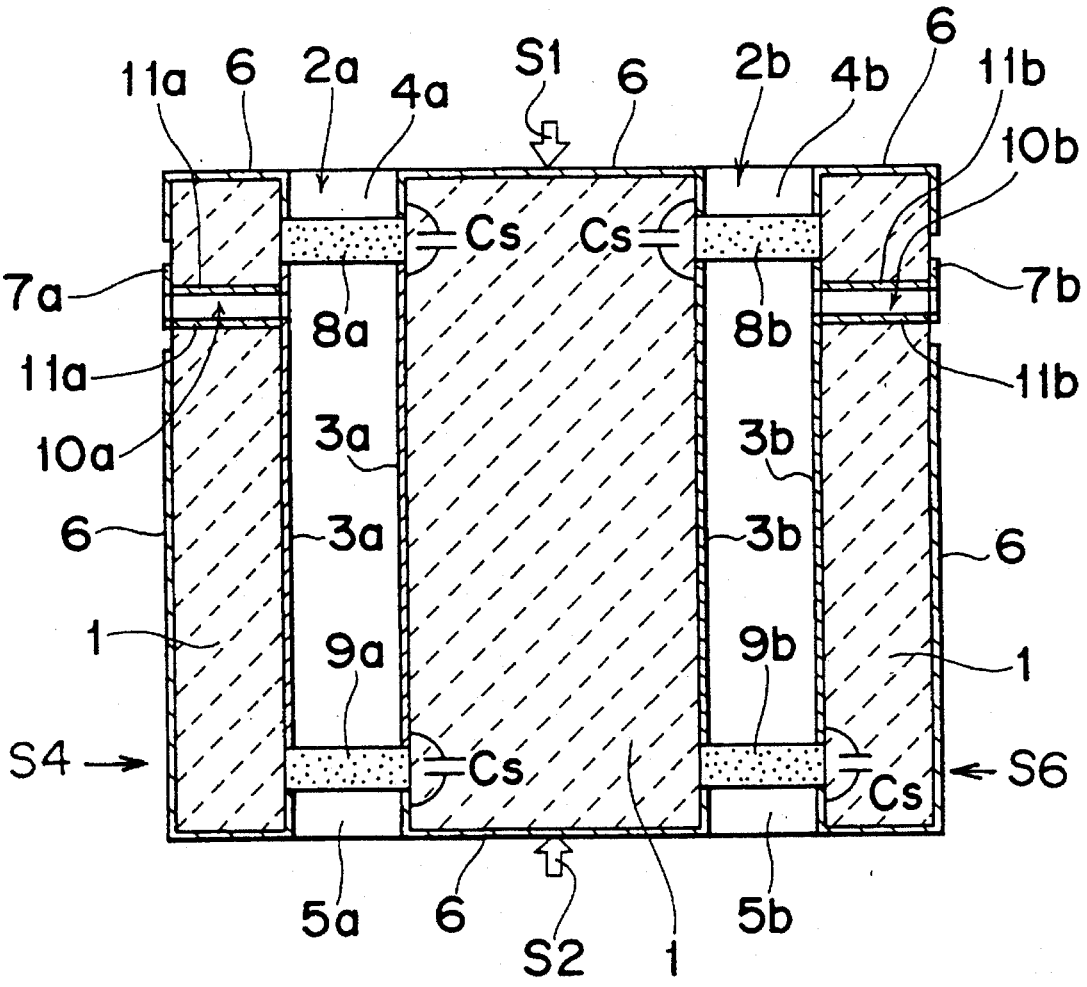
FIG. 11 is a cross-sectional view of a dielectric resonator apparatus according to a modification of the first preferred embodiment of the present invention.

As shown in FIG. 11 showing a modification of the first preferred embodiment of the present invention when seen in a direction opposite to that of FIG. 2, a pair of circular cylindrical penetrating holes 10*a* and 10*b* may be formed in a direction perpendicular to the axes of the resonator holes 2*a* and 2*b*, respectively, so as to penetrate the dielectric block 1 and also to extend from a pair of input and output electrodes 7*a* and 7*b* to the resonator holes 2*a* and 2*b* located at both ends of the dielectric block 1, and then inner connection conductors 11*a* and 11*b* may be formed on the inner peripheral surfaces of the penetrating holes 10*a* and 10*b*, respectively. In this arrangement, the penetrating hole 10*a* has an opening on the side surface S4 of the dielectric block 1 and another opening on the inner conductor 3*a*, and the penetrating hole 10*b* has an opening on the side surface S6 of the dielectric block 1 and another opening on the inner conductor 3*b*. Then a pair of input and output electrodes 7*a* and 7*b* is electrically connected respectively through the inner connection conductors 11*a* and 11*b* to the inner conductors 3*a* and 3*b* located at both ends of the dielectric block 1. This modification can be applied to the second and third preferred embodiments as well.

According to the above-mentioned preferred embodiments, both ends of the inner conductors 3*a*, 3*b* and 3*c* located in the vicinity of both the opening surfaces of the resonator holes 2*a*, 2*b* and 2*c* are not short-circuit ends but rather are open-circuit ends. Therefore, there is no deterioration in the no-loaded Q ($Q_0$) of the dielectric coaxial resonators due to current concentration in the vicinity of opening surfaces of the resonator holes 2*a*, 2*b* and 2*c*, and further there is almost never caused any electromagnetic leak from the openings of the resonator holes 2*a*, 2*b* and 2*c*.

Figure 10:
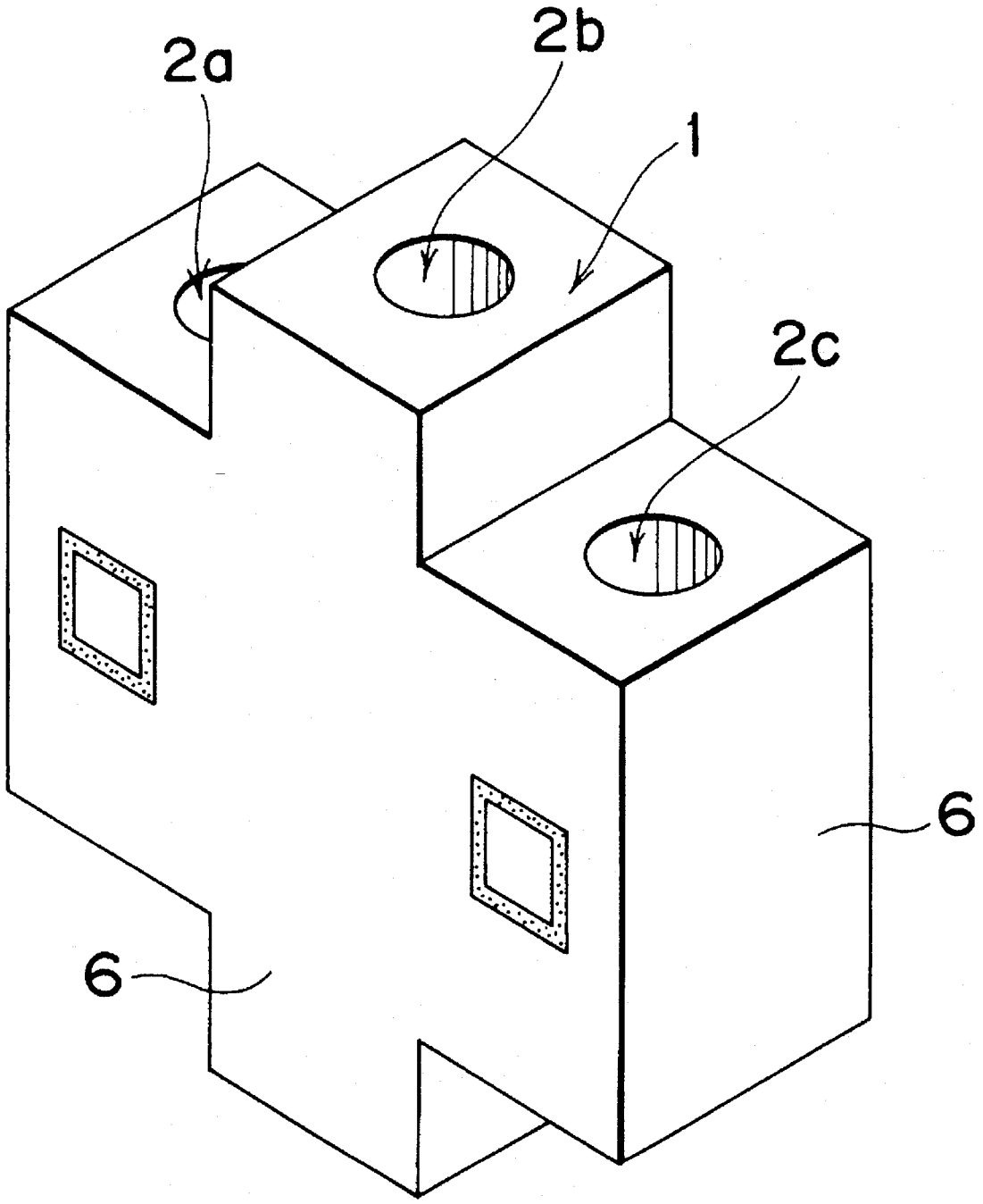
Fig. 10 PRIOR ART
FIG. 10 is a perspective view showing an appearance of a second conventional dielectric resonator apparatus.

Further, even though the height of the dielectric block 1 parallel to the axial direction of the dielectric coaxial resonator is a constant, the longitudinal lengths of the inner conductors 3*a*, 3*b* and 3*c*, namely, the lengths of the axes of the dielectric coaxial resonators can be set to desirable lengths by adjusting the positions and the widths of the above-mentioned gaps 8*a*, 9*a*, 8*b*, 9*b*, 8*c* and 9*c* formed in the inner portions of the resonator holes 2*a*, 2*b* and 2*c*. Therefore, the dielectric resonator apparatus comprising three or more dielectric coaxial resonators can be constituted without forming steps in the dielectric block 1 as shown in FIG. 10, resulting in a decrease in the manufacturing cost.

Furthermore, the axial longitudinal lengths of the dielectric coaxial resonators for obtaining the same resonance frequency can be reduced by the end capacitances Cs formed at both ends of the inner conductors 3*a*, 3*b* and 3*c*. This results in that the whole size of the dielectric resonator apparatus can be miniaturized.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A dielectric resonator apparatus comprising:

a dielectric block of a dielectric material having first and second surfaces, and a plurality of side surfaces located between the first surface and the second surface;

a plurality of cylindrical resonator holes disposed in parallel to each other so as to penetrate an inner portion of the dielectric block, each of the resonator holes having an opening at the first surface of the dielectric block and another opening at the second surface of said dielectric block;

an outer conductor disposed on the first and second surfaces and the plurality of side surfaces of said dielectric block;

a plurality of half-wavelength inner conductors disposed on inner portions of the plurality of resonator holes, respectively;

a plurality of extending conductors disposed in the vicinity of the openings of the plurality of resonator holes, respectively, so as to extend from the outer conductor into the inner portions of the plurality of resonator holes and so as to define respective gaps between said respective plurality of extending conductors of said corresponding inner conductors, each of the inner conductors having respective open-circuit ends in the vicinity of both the openings of said resonator holes, thereby constituting a plurality of half-wavelength dielectric coaxial resonators; and a pair of input and output electrodes each disposed on at least one of the side surfaces of the dielectric block so as to be electrically insulated from the outer conductor, and so as to be in close proximity to open-circuit ends of two of the plurality of inner conductors, respectively.

2. The apparatus as claimed in claim 1, wherein the pair of input and output electrodes are disposed so as to be in close proximity to the first surface of said dielectric block.

3. The apparatus as claimed in claim 1, wherein the pair of input and output electrodes are disposed diagonally on a common side surface, respectively, so as to be in close proximity to the first and second surface of said dielectric block respectively.

4. The apparatus as claimed in claim 1, wherein said plurality of inner conductors are an odd number of cylindrical inner conductors equal to at least three, each of the cylindrical inner conductors having a respective center axis, wherein said odd number of cylindrical inner conductors are disposed so as to be symmetrical with respect to the center axis of a cylindrical inner conductor located in a middle of the odd number of cylindrical inner conductors.

5. The apparatus as claimed in claim 4, wherein the plurality of dielectric coaxial resonators are first, second and third dielectric coaxial resonators provided in that order so as to be parallel to each other and spaced apart from each other by a respective predetermined distance, each of the dielectric coaxial resonators having a respective cylindrical inner conductor, the cylindrical inner conductor having a corresponding longitudinal length, wherein each of the respective longitudinal lengths of the corresponding cylindrical inner conductors of the first and third dielectric coaxial resonators is a first length, and the longitudinal length of the cylindrical inner conductor of said second dielectric coaxial resonator is a second length greater than the first length.

6. The apparatus as claimed in claim 1, wherein the plurality of dielectric coaxial resonators are first, second and third dielectric coaxial resonators provided in that order so as to be parallel to each other and spaced apart from each other by a respective predetermined distance, each of said dielectric coaxial resonators having a respective cylindrical inner conductor, the cylindrical inner conductor having a corresponding longitudinal length, wherein each of the respective longitudinal lengths of the corresponding cylindrical inner conductors of the first and third dielectric coaxial resonators is a first length, and the longitudinal length of the cylindrical inner conductor of said second dielectric coaxial resonator is a second length greater than the first length.

7. The apparatus as claimed in claim 1, wherein the plurality of cylindrical resonator holes include first and last cylindrical resonator holes disposed in parallel to each other and spaced apart from each other by a respective predetermined distance, each of the plurality of cylindrical resonator holes has a respective center axis, the apparatus further comprising:

a pair of penetrating holes disposed in a direction perpendicular the respective center axis of said respective resonator holes so as to penetrate the dielectric block and so as to extend from a said pair of input and output electrodes to the first and last resonator holes, respectively and inner connection conductors for electrically connecting the pair of input and output electrode to the first and last inner conductors, respectively, the inner connection conductors being disposed in inner portions of the pair of penetrating holes, respectively.

8. The apparatus as claimed in claim 7, wherein the input and output electrodes are disposed on different respective side surfaces of said dielectric block.

9. The apparatus as claimed in claim 7, wherein the input and output electrodes are disposed on a common side surface of the dielectric block.

10. The apparatus as claimed in claim 9, wherein the input and output electrodes are extended from said common side surface onto respective different side surfaces of said dielectric block.

* * * * *